US012595722B2

(12) United States Patent
Eldemellawi et al.

(10) Patent No.: US 12,595,722 B2
(45) Date of Patent: Apr. 7, 2026

(54) SYSTEMS AND METHODS FOR WELL PERFORATION

(71) Applicant: SAUDI ARABIAN OIL COMPANY, Dhahran (SA)

(72) Inventors: Jehad K. Eldemellawi, Thuwal (SA); Faisal M. Alissa, Al-Riyadh (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/755,425

(22) Filed: Jun. 26, 2024

(65) Prior Publication Data

US 2026/0002426 A1 Jan. 1, 2026

(51) Int. Cl.
*E21B 43/1185* (2006.01)
*E21B 43/117* (2006.01)

(52) U.S. Cl.
CPC ..... *E21B 43/1185* (2013.01); *E21B 43/117* (2013.01)

(58) Field of Classification Search
CPC ..... E21B 43/1185; E21B 43/117
See application file for complete search history.

(56) References Cited

U.S. PATENT DOCUMENTS 3,090,714 A 5/1963 Fenix
5,859,383 A * 1/1999 Davison ..... C06B 25/34 102/307
9,291,039 B2 * 3/2016 King ..... B22F 3/1258
10,508,040 B2 12/2019 Chaieb et al.
2003/0037692 A1 * 2/2003 Liu ..... F42B 1/032 102/301
2003/0062153 A1 4/2003 Broad
2003/0148569 A1 * 8/2003 Diener ..... C06B 45/30 438/200
2004/0244889 A1 12/2004 Sailor et al.
(Continued)

FOREIGN PATENT DOCUMENTS

AU 2007/249074 A1 1/2008
CN 85101936 B 12/1988
FR 862323 A 3/1941

OTHER PUBLICATIONS

Monuko du Plessis, A Decade of Porous Silicon as Nano-Explosive Material, applicant's prior art, submitted Jul. 18, 2024. (Year: 2013).*

(Continued)

*Primary Examiner* — James G Sayre
(74) *Attorney, Agent, or Firm* — Vorys, Sater, Seymour and Pease LLP

(57) ABSTRACT

Well perforation methods of the present disclosure may comprise introducing a perforation bullet into a wellbore comprising a well casing, the wellbore penetrating a subterranean formation; wherein the perforation bullet comprises a housing; an explosive within the housing, the explosive comprising amorphous porous silicon; and an igniter within the housing physically separated from the explosive, the igniter comprising a nitrate; and exposing the explosive to the igniter to induce a detonation to produce a plurality of perforations within the well casing, thereby allowing fluid communication between the subterranean formation and the wellbore.

16 Claims, 1 Drawing Sheet

(56) References Cited

U.S. PATENT DOCUMENTS

| | | | | |
|---|---|---|---|---|
| 2006/0266551 | A1* | 11/2006 | Yang | E21B 43/116 175/4.6 |
| 2010/0101783 | A1 | 4/2010 | Mnegar et al. | |
| 2014/0227548 | A1 | 8/2014 | Myrick | |
| 2015/0275642 | A1* | 10/2015 | Braithwaite | E21B 43/11 166/299 |

OTHER PUBLICATIONS

Plessis, "A Decade of Porous Silicon as Nano-Explosive Material", Propellants, Explosives, Pyrotechnics, 2014, pp. 348-364, vol. 39; DOI: 10.1002/prep.201300053.

* cited by examiner

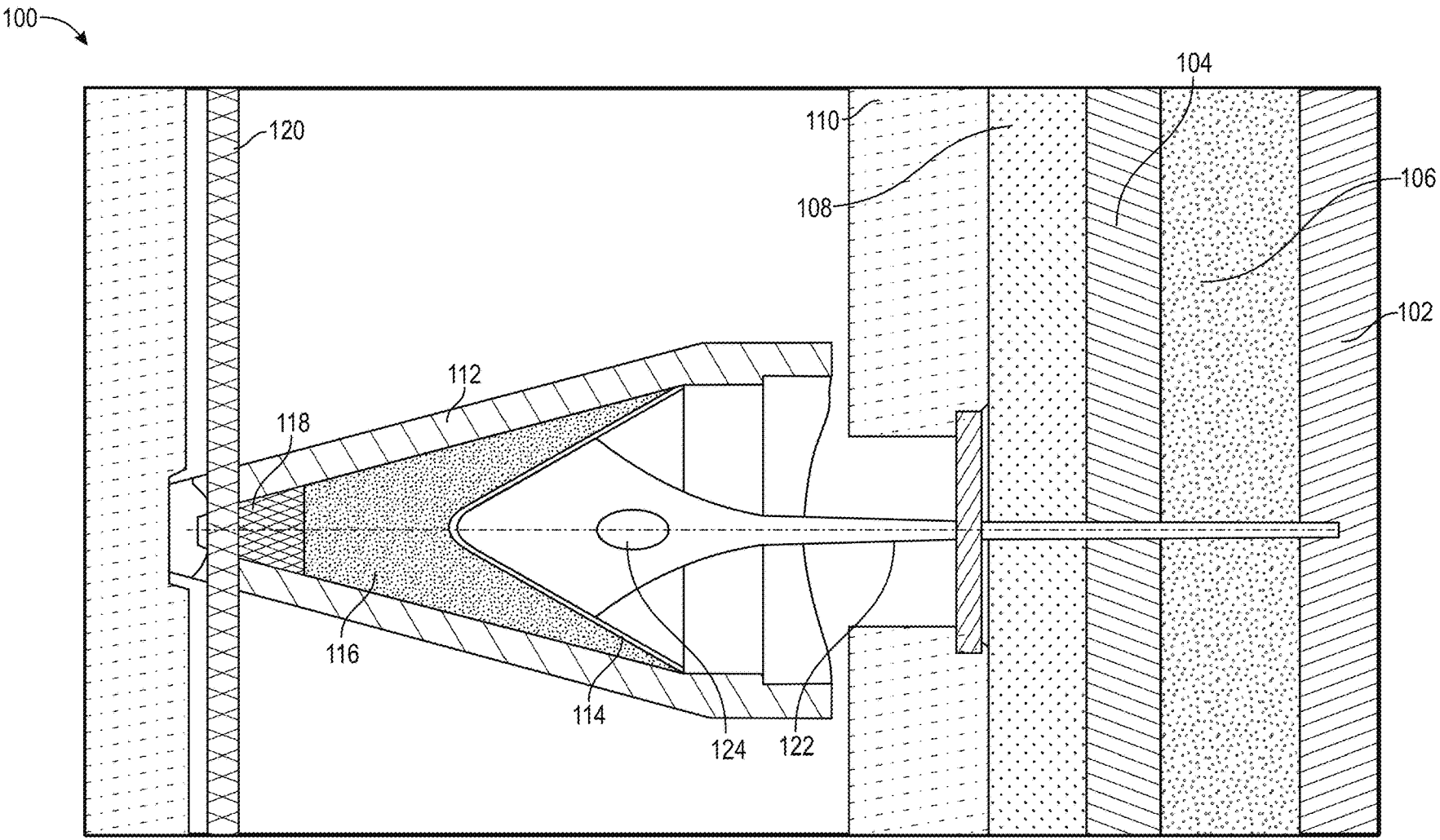
100
104
106
102
110
108
122
124
114
112
116
118
120

SYSTEMS AND METHODS FOR WELL PERFORATION

FIELD OF THE DISCLOSURE

The present disclosure relates generally to well perforation and, more particularly, to well perforation using explosive perforation bullets.

BACKGROUND OF THE DISCLOSURE

Oil and gas wells require the creation of a communication path between the wellbore and the surrounding hydrocarbon-bearing formations to facilitate the flow of oil or gas into the wellbore, from which the hydrocarbons may be extracted to the surface. Perforation plays a pivotal role in this aspect of well completion, wherein holes or openings are created in the casing or liner of the wellbore. These openings may allow hydrocarbons to migrate from the surrounding rock formations into the wellbore, thereby enhancing production efficiency.

Traditionally, the perforation of well casings and liners has been accomplished through a variety of techniques. These techniques include the use of explosive charges, perforation guns that project charges to puncture the casing, and mechanical perforators that physically penetrate the casing and cement barrier. The use of explosive charges is a favored technique due to its effectiveness in breaching the well casing and cement barrier, creating the necessary pathways for oil and gas to enter the wellbore. This method leverages the controlled detonation of explosive materials to puncture the casing, contrasting with mechanical perforators that physically penetrate the barriers. The explosive method is particularly valued for its ability to achieve a significant penetration depth and create a large number of perforations in a single operation, factors critical to enhancing the extraction efficiency of oil and gas wells.

Despite the critical importation of perforation in hydrocarbon extraction, the use of explosive charges is not without challenges. A primary concern is the accuracy of the perforation process. While explosive charges can create extensive perforation networks, controlling the size and direction of these openings may be difficult, leading to less than optimal hydrocarbon flow and potential risks to the structural integrity of the well casing and the surrounding subterranean formation. Consequently, explosive charges having improved detonation control would be highly valuable for use in well perforation.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, well perforation systems may include a housing; an explosive within the housing, the explosive comprising amorphous porous silicon; and an igniter within the housing physically separated from the explosive, the igniter comprising a nitrate.

In another embodiment, well perforation methods may include introducing a perforation bullet into a wellbore comprising a well casing, the wellbore penetrating a subterranean formation; wherein the perforation bullet comprises a housing; an explosive within the housing, the explosive comprising amorphous porous silicon; and an igniter within the housing physically separated from the explosive, the igniter comprising a nitrate; and exposing the explosive to the igniter to induce a detonation to produce a plurality of perforations within the well casing, thereby allowing fluid communication between the subterranean formation and the wellbore.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

BRIEF DESCRIPTION OF THE DRAWINGS

The FIGURE is a schematic of a perforation bullet detonation within a wellbore penetrating a subterranean formation.

DETAILED DESCRIPTION

Embodiments in accordance with the present disclosure generally relate to well perforation and, more particularly, to well perforation using explosive perforation bullets. As previously mentioned, although explosively-charged perforation bullets are capable of generating widespread networks of perforations, managing the dimensions and trajectory of these perforations can be challenging, potentially resulting in suboptimal hydrocarbon extraction and damage to the structural stability of the well casing and the surrounding subterranean formation. Therefore, explosive charges having enhanced detonation precision would be beneficial in well perforation applications. The present disclosure addresses the foregoing challenges by providing explosively-charged perforation bullets comprising amorphous porous silicon. When utilized as an explosive charge, amorphous porous silicon possesses a distinct combination of high-energy discharge and managed fragmentation properties, and may present numerous benefits over conventional explosives. The amorphous state of the porous silicon contributes to superior energy absorption and fragmentation upon impact, equipping perforation bullets with enhanced penetrating power. Moreover, the porous microstructure of amorphous porous silicon further boosts its performance by creating more pathways for energy dispersion and controlled breaking. This synergy of intense energy release and porosity not only facilitates effective penetration through well casings and subterranean formations but also reduces the risk of damage to adjacent structures. Employing amorphous porous silicon in explosive charges for perforation bullets may represent a promising avenue for improving operational safety and detonation effectiveness.

Therefore, non-limiting example systems for well perforation may comprise: a housing; an explosive within the housing, the explosive comprising amorphous porous silicon; and an igniter within the housing physically separated from the explosive, the igniter comprising a nitrate.

Similarly, non-limited example methods for well perforation may comprise: introducing a perforation bullet into a wellbore comprising a well casing, the wellbore penetrating a subterranean formation; wherein the perforation bullet comprises: a housing; an explosive within the housing, the explosive comprising amorphous porous silicon; and an igniter within the housing physically separated from the explosive, the igniter comprising a nitrate; and exposing the explosive to the igniter to induce a detonation to produce a plurality of perforations within the well casing, thereby allowing fluid communication between the subterranean formation and the wellbore.

The FIGURE is an example schematic of a perforation bullet detonation within a wellbore 100 penetrating a subterranean formation 102. The wellbore 100 may consist of a well casing 104 and a cement barrier 106 surrounding the well casing 104. A layer of wellbore fluid 108 (e.g., a drilling fluid, such as an oil-based drilling fluid) may also be present on the interior of the well casing 104. A perforation bullet may be lowered into the wellbore 100 by a carrier 110 (e.g., a perforation gun). The perforation bullet may comprise an external housing 112 and an internal liner 114, separately containing the explosive 116 and igniter 118, the igniter 118 being contained within a blasting cap. The housing 112 may be metallic and, for example, may be composed of steel. The internal liner 114 may comprise a malleable material, such as solid copper and/or copper alloys (e.g., gilding metal). The perforation bullet may be connected to a detonator cord 120. The detonator cord 120 may be in communication with the igniter 118 within the perforation bullet and may comprise low strength materials, such as a plastic, wrapped in one or more metals.

During the initiation of the perforation bullet detonation, the detonator cord 120 may produce a shockwave that impacts and cracks the blasting cap, causing a release of the igniter 118. When the explosive 116 is exposed to the igniter 118, a detonation may occur, producing a stream 122 of thermal energy. The energy of stream 122 may convey a physical projectile 124 into the well casing 104, producing a plurality of perforations within the well casing 104 and cement barrier 106, extending into the subterranean formation 102. The perforations may allow fluid communication between the subterranean formation 102 and the wellbore 100.

The explosive within the perforation bullet may comprise a porous material, such as amorphous porous silicon. Although the example perforation bullet described by the FIGURE may be preferable, it is noted that one skilled in the art would recognize that the concept of amorphous porous silicon as an explosive may be applied to any method of well perforation, including variant forms of perforation bullets.

In any embodiment, the amorphous porous silicon may be prepared by any suitable technique, including wet etching. Wet etching may comprise submerging crystalline silicon powder in an etchant in the presence of metal ion-based oxidants to stimulate the formation reaction of the porous silicon. Suitable etchants include acids such as hydrochloric acid, hydrofluoric acid, the like, and any combination thereof. Metal ion-based oxidants may include iron (III) salts such as iron (III) chloride, iron (III) sulfate, the like, and any combination thereof. This process may produce amorphous porous silicon clusters having a diameter of about 6 μm to about 10 μm, or about 6 μm to about 9 μm, or about 6 μm to about 8 μm, or about 6 μm to about 7 μm, or about 7 μm to about 9 μm, or about 7 μm to about 8 μm, or about 8 μm to about 9 μm.

Furthermore, the amorphous porous silicon may have an average pore diameter of, for example, about 1 nm to about 10 nm, or about 1 nm to about 7.5 nm, or about 1 nm to about 5 nm, or about 1 nm to about 2.5 nm, or about 2.5 nm to about 10 nm, or about 2.5 nm to about 7.5 nm, or about 2.5 to about 5 nm, or about 5 nm to about 10 nm, or about 5 nm to about 7.5 nm, or about 7.5 nm to about 10 nm.

The amorphous porous silicon may, for example, have a total surface area of about 400 $m^2/g$ to about 600 $m^2/g$, or about 400 $m^2/g$ to about 550 $m^2/g$, or about 400 $m^2/g$ to about 500 $m^2/g$, or about 400 $m^2/g$ to about 450 $m^2/g$, or about 450 $m^2/g$ to about 600 $m^2/g$, or about 450 $m^2/g$ to about 550 $m^2/g$, or about 450 $m^2/g$ to about 500 $m^2/g$, or about 500 $m^2/g$ to about 600 $m^2/g$, or about 500 $m^2/g$ to about 550 $m^2/g$, or about 550 $m^2/g$ to about 600 $m^2/g$.

In any embodiment, the perforation bullet may contain enough explosive to adequately perforate the well casing and additional well linings. For example, the amount of explosive in the perforation bullet may be about 0.05 g to about 50 g, or about 0.05 g to about 25 g, or about 0.05 g to about 10 g, or about 0.05 g to about 5 g, or about 0.05 g to about 1 g, or about 1 g to about 50 g, or about 1 g to about 25 g, or about 1 g to about 10 g, or about 1 g to about 5 g, or about 5 g to about 50 g, or about 5 g to about 25 g, or about 5 g to about 10 g, or about 10 g to about 50 g, or about 10 g to about 25 g, or about 25 g to about 50 g.

The igniter may comprise any suitable oxidant that may induce the ignition, or detonation, of the amorphous porous silicon in the explosive. For example, the igniter may comprise a nitrate such as calcium nitrate, sodium nitrate, potassium nitrate, ammonium nitrate, magnesium nitrate, gadolinium nitrate, the like, and any combination thereof. Preferably, the igniter may comprise calcium nitrate tetrahydrate.

Embodiments disclosed herein include:

A. Well perforation systems comprising: a housing; an explosive within the housing, the explosive comprising amorphous porous silicon; and an igniter within the housing physically separated from the explosive, the igniter comprising a nitrate.

B. Well perforation methods comprising: introducing a perforation bullet into a wellbore comprising a well casing, the wellbore penetrating a subterranean formation; wherein the perforation bullet comprises: a housing; an explosive within the housing, the explosive comprising amorphous porous silicon; and an igniter within the housing physically separated from the explosive, the igniter comprising a nitrate; and exposing the explosive to the igniter to induce a detonation to produce a plurality of perforations within the well casing, thereby allowing fluid communication between the subterranean formation and the wellbore.

Each of embodiments A and B may have one or more of the following additional elements in any combination:

Element 1: wherein the system comprises about 0.05 g to about 50 g of the explosive.

Element 2: wherein the amorphous porous silicon has a total surface area of about 400 $m^2/g$ to about 600 $m^2/g$.

Element 3: wherein the amorphous porous silicon comprises clusters having a diameter of about 6 μm to about 10 μm.

Element 4: wherein the amorphous porous silicon has an average pore diameter of about 1 nm to about 10 nm.

Element 5: wherein the nitrate comprises calcium nitrate tetrahydrate.

Element 6: wherein the housing comprises an exterior casing and an interior liner, wherein the explosive and igniter are contained within the casing and liner.

Element 7: wherein the casing comprises steel.

Element 8: wherein the liner comprises copper.

Element 9: wherein the system is connected to a detonator cord.

By way of non-limiting example, exemplary combinations applicable to A and B include: 1 with 2; 1 with 3; 1 with 4; 1 with 5; 1 with 6; 1 with 9; 2 with 3; 2 with 4; 2 with 5; 2 with 6; 2 with 9; 3 with 4; 3 with 5; 3 with 6; 3 with 9; 4 with 5; 4 with 6; 4 with 9; 5 with 6; 5 with 9; 6 with 9; 7 with 8; 7 with 9; 8 with 9; 1 with 2 and 3; 2 with 3 and 4; 3 with 4 and 5; 4 with 5 and 6; 5 with 6 and 9.

The present disclosure is further directed to the following non-limiting causes:

Clause 1. A system comprising:
- a housing;
- an explosive within the housing, the explosive comprising amorphous porous silicon; and
- an igniter within the housing physically separated from the explosive, the igniter comprising a nitrate.

Clause 2. The system of clause 1, wherein the system comprises about 0.05 g to about 50 g of the explosive.

Clause 3. The system of clause 1 or clause 2, wherein the amorphous porous silicon has a total surface area of about 400 $m^2/g$ to about 600 $m^2/g$.

Clause 4. The system of any one of clauses 1-3, wherein the amorphous porous silicon comprises clusters having a diameter of about 6 μm to about 10 μm.

Clause 5. The system of any one of clauses 1-4, wherein the amorphous porous silicon has an average pore diameter of about 1 nm to about 10 nm.

Clause 6. The system of any one of clauses 1-5, wherein the nitrate comprises calcium nitrate tetrahydrate.

Clause 7. The system of any one of clauses 1-6, wherein the housing comprises an exterior casing and an interior liner, wherein the explosive and igniter are contained within the casing and liner.

Clause 8. The system of clause 7, wherein the casing comprises steel.

Clause 9. The system of clause 7 or clause 8, wherein the liner comprises copper.

Clause 10. The system of any one of clauses 1-9, wherein the system is connected to a detonator cord.

Clause 11. A method comprising:
- introducing a perforation bullet into a wellbore comprising a well casing, the wellbore penetrating a subterranean formation;
  - wherein the perforation bullet comprises:
    - a housing;
    - an explosive within the housing, the explosive comprising amorphous porous silicon; and
    - an igniter within the housing physically separated from the explosive, the igniter comprising a nitrate; and
- exposing the explosive to the igniter to induce a detonation to produce a plurality of perforations within the well casing, thereby allowing fluid communication between the subterranean formation and the wellbore.

Clause 12. The method of clause 11, wherein the perforation bullet comprises about 0.05 g to about 50 g of the explosive.

Clause 13. The method of clause 11 or clause 12, wherein the amorphous porous silicon has a total surface area of about 400 $m^2/g$ to about 600 $m^2/g$.

Clause 14. The method of any one of clauses 11-13, wherein the amorphous porous silicon comprises clusters having a diameter of about 6 μm to about 10 μm.

Clause 15. The method of any one of clauses 11-14, wherein the amorphous porous silicon has an average pore diameter of about 1 nm to about 10 nm.

Clause 16. The method of any one of clauses 1-15, wherein the nitrate comprises calcium nitrate tetrahydrate.

Clause 17. The method of any one of clauses 1-16, wherein the housing comprises an exterior casing and an interior liner, wherein the explosive and igniter are contained within the casing and liner.

Clause 18. The method of clause 17, wherein the casing comprises steel.

Clause 19. The method of clause 17 or clause 18, wherein the liner comprises copper.

Clause 20. The method of any one of clauses 11-19, wherein the perforation bullet is connected to a detonator cord.

EXAMPLES

Amorphous porous silicon was synthesized using wet etching of crystalline silicon powder. Crystalline silicon powder was submerged in an etchant composed of hydrochloric acid and hydrofluoric acid in the presence of iron(III) chloride and iron(III) sulfate to stimulate the formation reaction of the porous silicon. The silicon-containing etching bath was left at room temperature for about 12 hours under magnetic stirring. To obtain the amorphous porous silicon microclusters, the etched silicon powder was washed with deionized water under several rounds of centrifugation and decantation until a pH of about 6 was achieved. Then, the washed sediment was suspended in hexane and sonicated for 30 minutes followed by overnight drying to obtain a hydrogen-terminated amorphous, porous silicon powder. Scanning electron microscopy showed that the amorphous porous silicon clusters had an average diameter of about 6 μm to about 10 μm. The Brunauer-Emmett-Teller characterization technique was used to measure the surface area and pore diameter of the amorphous porous silicon. The amorphous porous silicon was found to have a total surface area of about 500 $m^2/g$ and an average pore size of about 4 nm. X-ray diffraction spectroscopy and FT-IR were performed to confirm the composition of the amorphous porous silicon.

The prepared amorphous porous silicon was detonated using a primer igniter comprising diluted methanol-containing nitrate-based hydroscopic salt (calcium nitrate tetrahydrate) at a concentration of approximately 1.88 g/L. 0.5 g of the dried amorphous porous silicon was placed on a laboratory workbench at room temperature and 1 μL of the igniter was brought in proximity to the amorphous porous silicon causing an instantaneous explosive reaction in about 9 μs.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains," "containing," "includes," "including," "comprises," and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

All documents described herein are incorporated by reference herein for purposes of all jurisdictions where such practice is allowed, including any priority documents and/or testing procedures to the extent they are not inconsistent with this text. As is apparent from the foregoing general description and the specific embodiments, while forms of the disclosure have been illustrated and described, various modifications can be made without departing from the spirit and scope of the disclosure. Accordingly, it is not intended that the disclosure be limited thereby. For example, the compositions described herein may be free of any component or composition not expressly recited or disclosed herein. Any method may lack any step not recited or disclosed herein. Likewise, the term "comprising" is considered synonymous with the term "including." Whenever a method, composition, element, or group of elements is preceded with the transitional phrase "comprising," it is understood that we also contemplate the same composition or group of elements with transitional phrases "consisting essentially of," "consisting of," "selected from the group consisting of," or "is" preceding the recitation of the composition, element, or elements and vice versa.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by one or more embodiments described herein. At the very least, and not as an attempt to limit the application of the doctrine of equivalents to the scope of the claim, each numerical parameter should at least be construed in light of the number of reported significant digits and by applying ordinary rounding techniques.

The invention claimed is:

1. A system comprising:

a housing;

an explosive within the housing, the explosive comprising amorphous porous silicon having a total surface area of about 450 $m^2/g$ to about 600 $m^2/g$;

an igniter within the housing physically separated from the explosive, the igniter comprising a nitrate; and a detonator cord in communication with the igniter and not contacting the explosive.

2. The system of claim 1, wherein the system comprises about 0.05 g to about 50 g of the explosive.

3. The system of claim 1, wherein the amorphous porous silicon comprises clusters having a diameter of about 6 μm to about 10 μm.

4. The system of claim 1, wherein the amorphous porous silicon has an average pore diameter of about 1 nm to about 10 nm.

5. The system of claim 1, wherein the nitrate comprises calcium nitrate tetrahydrate.

6. The system of claim 1, wherein the housing comprises an exterior casing and an interior liner, wherein the explosive and igniter are contained within the casing and liner.

7. The system of claim 6, wherein the casing comprises steel.

8. The system of claim 6, wherein the liner comprises copper.

9. A method comprising:

introducing a perforation bullet into a wellbore comprising a well casing, the wellbore penetrating a subterranean formation;

wherein the perforation bullet comprises:

a housing;

an explosive within the housing, the explosive comprising amorphous porous silicon having a total surface area of about 450 $m^2/g$ to about 600 $m^2/g$;

an igniter within the housing physically separated from the explosive, the igniter comprising a nitrate; and a detonator cord in communication with the igniter and not contacting the explosive; and exposing the explosive to the igniter to induce a detonation to produce a plurality of perforations within the well casing, thereby allowing fluid communication between the subterranean formation and the wellbore.

10. The method of claim 9, wherein the perforation bullet comprises about 0.05 g to about 50 g of the explosive.

11. The method of claim 9, wherein the amorphous porous silicon comprises clusters having a diameter of about 6 μm to about 10 μm.

12. The method of claim 9, wherein the amorphous porous silicon has an average pore diameter of about 1 nm to about 10 nm.

13. The method of claim 9, wherein the nitrate comprises calcium nitrate tetrahydrate.

14. The method of claim 9, wherein the housing comprises an exterior casing and an interior liner, wherein the explosive and igniter are contained within the casing and liner.

15. The method of claim 14, wherein the casing comprises steel.

16. The method of claim 14, wherein the liner comprises copper.

* * * * *